US007938265B2

(12) United States Patent
Bitner

(10) Patent No.: US 7,938,265 B2
(45) Date of Patent: May 10, 2011

(54) MEDICAMENT DISPENSER AND METHOD

(75) Inventor: John Bitner, Sugar Grove, IL (US)

(73) Assignee: Watson Laboratories, Inc., Corona, CA (US)

( * ) Notice: Subject to any disclaimer, the term of this patent is extended or adjusted under 35 U.S.C. 154(b) by 0 days.

(21) Appl. No.: 12/367,501

(22) Filed: Feb. 6, 2009

(65) Prior Publication Data

US 2009/0139894 A1 Jun. 4, 2009

Related U.S. Application Data

(63) Continuation-in-part of application No. 11/316,673, filed on Dec. 21, 2005.

(60) Provisional application No. 61/074,438, filed on Jun. 20, 2008.

(51) Int. Cl.
*B65D 43/16* (2006.01)

(52) U.S. Cl. ..... 206/536; 206/1.5; 206/528

(58) Field of Classification Search ..... 206/528, 206/229, 459.5, 531, 534, 536, 539, 530, 206/1.5; 312/9.16, 9.11; 70/14, 57, 58, 63, 70/158, 163; 292/DIG. 53, DIG. 54, 256
See application file for complete search history.

(56) References Cited

U.S. PATENT DOCUMENTS

| | | | |
|---|---|---|---|
| 405,003 | A | 6/1889 | Blackledge |
| 1,455,432 | A | 5/1923 | Dodson |
| 2,218,199 | A | 10/1940 | Hauton |
| 2,681,677 | A | 6/1954 | Poeltl |
| 3,124,187 | A | 3/1964 | Bosca |
| 3,182,789 | A | 5/1965 | Sparks |
| 3,242,959 | A | 3/1966 | Glass |
| 3,504,788 | A | 4/1970 | Gray |
| 3,832,874 | A | 9/1974 | Willis |

(Continued)

FOREIGN PATENT DOCUMENTS

DE 88 11 924.4 U1 2/1989

(Continued)

OTHER PUBLICATIONS

International Search Report for PCT/US2009/047798 dated Oct. 6, 2009.

*Primary Examiner* — J. Gregory Pickett
*Assistant Examiner* — Andrew Perreault
(74) *Attorney, Agent, or Firm* — Kenealy Vaidya LLP

(57) ABSTRACT

A medicament dispenser can include a first side surface, a second side surface spaced from and substantially opposed to the first side surface, and a medicament packaging structure located between the first side surface and second side surface. A pivot structure can extend between the first side surface and the second side surface, and the medicament packaging structure can be rotatable about the pivot structure. Thus, the medicament packaging structure can be rotated from an enclosed state in which the medicament packaging structure is substantially enclosed by the first side surface and/or second side surface, to an exposed state in which the medicament packaging structure is substantially exposed from at least one of the first side surface and/or second side surface to provide user access to the medicament(s) stored in the medicament packaging structure. A lock structure can be located adjacent the first side surface and second side surface in order to selectively prevent movement and/or rotation of the medicament packaging structure. A method of using and making the medicament dispenser are also disclosed.

27 Claims, 8 Drawing Sheets

U.S. PATENT DOCUMENTS

| | | | | | |
|---|---|---|---|---|---|
| 3,958,690 | A | | 5/1976 | Gee, Sr. | |
| 4,363,403 | A | * | 12/1982 | Raucci et al. | 206/1.5 |
| 4,384,649 | A | | 5/1983 | Brodsky | |
| 4,511,032 | A | | 4/1985 | Bush | |
| 4,520,921 | A | * | 6/1985 | Vissing | 206/1.5 |
| 4,535,890 | A | | 8/1985 | Artusi | |
| 4,685,558 | A | * | 8/1987 | Filiz et al. | 206/1.5 |
| 4,741,433 | A | | 5/1988 | Irvine | |
| 4,817,819 | A | | 4/1989 | Kelly | |
| 4,889,238 | A | | 12/1989 | Batchelor | |
| 4,915,256 | A | | 4/1990 | Tump | |
| 4,984,825 | A | | 1/1991 | Fowler | |
| 4,998,623 | A | | 3/1991 | Doull | |
| D324,305 | S | | 3/1992 | Prey | |
| 5,109,984 | A | | 5/1992 | Romick | |
| 5,265,728 | A | | 11/1993 | Allendorf et al. | |
| 5,348,158 | A | | 9/1994 | Honan et al. | |
| 5,570,810 | A | | 11/1996 | Lambelet, Jr. et al. | |
| 5,878,887 | A | | 3/1999 | Parker et al. | |
| 5,915,559 | A | | 6/1999 | Hulick et al. | |
| 6,021,901 | A | * | 2/2000 | Wolfe | 206/1.5 |
| 6,173,838 | B1 | | 1/2001 | Brozell | |
| 6,263,141 | B1 | | 7/2001 | Smith | |
| 6,318,550 | B1 | | 11/2001 | Giovinazzi | |
| 6,338,408 | B1 | | 1/2002 | Anderson | |
| 6,540,081 | B2 | | 4/2003 | Balz et al. | |
| 6,675,972 | B2 | | 1/2004 | Patterson | |
| 6,789,677 | B2 | | 9/2004 | Maietta | |
| D498,787 | S | | 11/2004 | Nelms et al. | |
| 6,832,686 | B2 | * | 12/2004 | Donegan | 206/1.5 |
| D502,596 | S | | 3/2005 | Smoot | |
| 7,093,736 | B2 | | 8/2006 | Maietta | |
| 2002/0185404 | A1 | * | 12/2002 | Donegan | 206/531 |
| 2003/0102321 | A1 | | 6/2003 | Maietta | |
| 2004/0188313 | A1 | | 9/2004 | Tedham | |
| 2005/0051454 | A1 | | 3/2005 | Coe et al. | |
| 2005/0082194 | A1 | | 4/2005 | Fry et al. | |
| 2005/0087473 | A1 | | 4/2005 | Fabricius et al. | |
| 2005/0115862 | A1 | | 6/2005 | Maietta | |
| 2006/0006091 | A1 | | 1/2006 | Maietta | |
| 2007/0138049 | A1 | | 6/2007 | Bitner | |

FOREIGN PATENT DOCUMENTS

| | | | |
|---|---|---|---|
| EP | 0232674 | | 8/1987 |
| WO | WO2006/043912 | A1 | 4/2006 |

* cited by examiner

MEDICAMENT DISPENSER AND METHOD

This application is a continuation-in-part and claims the priority benefit under 35 U.S.C. §120 of co-pending U.S. patent application Ser. No. 11/316,673 filed on Dec. 21, 2005, and also claims the priority benefit under 35 U.S.C. §119 of co-pending U.S. Provisional Patent Application No. 61/074,438 filed on Jun. 20, 2008, which are both hereby incorporated in their entirety by reference.

BACKGROUND

1. Field

The disclosed subject matter relates generally to systems and methods for storing and dispensing medicaments. More particularly, the disclosed subject matter relates to medicament dispensing systems that include a lock structure configured to retain a medicament packaging structure within a housing structure along with methods for use and manufacture associated therewith.

2. Description of the Related Art

Medicament dispensing and organizing devices range from a simple plastic "pill box" to more complicated rotary dial and dated dispenser systems. Recently, the use of blister packs has become popular to dispense medicaments. Medicament products such as pharmaceutical medicines, over the counter medicines, dietary supplements, medicated chewing gum, and other conventionally known medicament type products are provided in blister packs that generally allow consumers to individually dispense a discrete quantity or unit of the product from the blister pack. In a typical application, each unit of the product contained in the blister pack is held in a separate "pocket," isolated from other units and also protected from exposure to contaminants, humidity, and other adverse environmental conditions. Three common methods for accessing medicament in a pocket of a blister pack are the "push method," which includes pushing the medicament through a rupturable wall of a blister pack; the "peel and push method," which includes peeling a protective layer from a blister pack and then pushing the medicament through a rupturable wall located under the protective layer; and, the "peel method," which includes peeling a protective layer from a blister pack and then simply accessing the medicament by allowing it to fall out or pushing it out of the blister pack. To dispense a product in the "push" and "peel and push" methods, a consumer generally applies pressure or force to a non-rupturable side of the blister pack, and a unit of product is thereby dispensed outwardly from an opposing side of the pack, the opposing side being ruptured as a result of application of the force. In the "peel and push method," access to products from a blister pack is accomplished by peeling a protective layer and then pushing a medicament through a secondary weaker layer of material. This arrangement can prevent inadvertent rupture of the secondary weaker layer and can prevent exposure of the protected pockets to children or other individuals or entities. In general, access to the products from the blister pockets can be made as intuitive and easy as feasible to provide seniors or those with disabilities with easy access to the products.

One particular application in which blister packs have found widespread use is in the area of medicament storage and packaging. Medicaments ranging from over-the-counter cold remedies to prescribed pain relief pharmaceuticals have been provided in a variety of blister pack configurations. Blister packs are popular in the field of medicine because they allow controlled dosage of discrete units of a medicament from the blister pack while non-dispensed medicament remaining in the blister pack is maintained in a protected state.

In addition, blister packs (as well as other medicament holding structures) have provided a way in which related medicaments, which form part of a common regime but have differing strengths and/or formulations, can be provided to a patient in a simple, comprehendible unit. For example, heart medication, stroke medication, urology medication and other medications in which child restraint is either desired or required have been provided in a blister pack format. Blister packs have also conveniently been used in products that currently do not require child restraint features, such as hormonal products and, in particular, birth control medication which is often prescribed on a 28-day cycle regime, with one group of tablets prescribed for the initial 21 days and another group of similar, but differing tablets, prescribed for the final 7-day increment. Information related to dosage, timing, sequencing, or the like can be printed on the blister pack to aid the user in determining how, when and which medicaments should be taken.

While blister packages provide many benefits, they also include some disadvantages. One such problem lies in the fact that blister packages are designed to dispense unit doses with relative ease. Thus, applying force to the non-rupturable side of the blister package should result in the opposing side rupturing relatively easily to dispense the medicament. While this design provides ease of dispensation, the medicament stored in the blister pack can be inadvertently dispensed from the blister pack when the non-rupturable side of the pack contacts other items, undesirably forcing medicament from the blisters of the pack and possibly contaminating the medicament or exposing it to undesirable environmental effects. In addition, the rupturable side of the pack can be compromised by contact with other items resulting in the same possibly undesirable effects.

Blister packs or other medicament holders can be configured to be relatively easy to transport in personal items such as a pocket, purse, handbag, briefcase, or other conventionally known carrying devices. However, removal of the blister packs or other medicament holders from the original carton or box in which they were provided can result in leaving behind important or necessary information printed on the carton or box. Thus, information such as drug interaction information, accidental ingestion information, dosage instructions, and warnings are often not carried with the blister packs containing the medicament to which the information relates.

Due to these considerations, attempts have been made to develop containers for storing blister packs or other holders of medicament that allow users to protectively and conveniently carry the blister packs or other holders. However, containers developed to date have proved overly complicated and bulky, and have dispensing mechanisms that can result in the medicament tablets or capsules becoming crushed, split or otherwise damaged during dispensing of the medication. In addition, many products fail to include structure for positively locking and/or retaining the blister pack within the container to prevent children or others from easily accessing the medicament or blister packages. The presently disclosed subject matter seeks to address these and other shortcomings of the conventional art while also addressing the long felt need for a medicament dispenser that is easy, intuitive, and convenient to use, is discrete, and also secures access to a medicament.

SUMMARY

According to one aspect of the disclosure, a medicament dispenser can include a first side surface, a second side surface spaced from and substantially opposed to the first side surface, a medicament packaging structure located between the first side surface and second side surface, a pivot structure extending between the first side surface and the second side surface, wherein the medicament packaging structure is rotatable about the pivot structure from an enclosed state in which the medicament packaging structure is substantially enclosed by the first side surface and second side surface to an exposed state in which the medicament packaging structure is substantially exposed from at least one of the first side surface and second side surface, and a primary lock structure located adjacent the first side surface and second side surface and configured to move with respect to the first side surface and second side surface between a locked state in which the primary lock structure prevents rotation, of the medicament packaging structure and an unlocked state in which rotation of the medicament packaging structure is not prevented by the primary lock structure. The primary lock structure can be configured in a manner that requires two simultaneous and distinct motions by a user to allow access to medicaments by the user.

According to another aspect of the disclosed subject matter, a medicament dispenser can include a first side surface comprising a first lock-receiving portion that is moveable with respect to a remainder portion of the first side surface, a second side surface spaced from and substantially opposed to the first side surface, the second side surface including a second lock-receiving portion that is moveable with respect to a remainder portion of the second side surface, a medicament packaging structure located between the first side surface and second side surface and configured to be moveable with respect to at least one of the first side surface and second side surface from an enclosed state in which the medicament packaging structure is substantially enclosed by the first side surface and second side surface to an exposed state in which the medicament packaging structure is substantially exposed from at least one of the first side surface and second side surface, and a primary lock structure that is moveable with respect to at least one of the first side surface and second side surface between a locked state in which the primary lock structure prevents movement of the medicament packaging structure and an unlocked state in which movement of the medicament packaging structure is not prevented by the primary lock structure, the primary lock structure including a mating structure that contacts at least a respective mating structure of at least one of the first lock-receiving portion and second lock-receiving portion when the primary lock structure is in the locked state.

According to another aspect of the disclosed subject matter, a method for making a medicament dispenser can include providing a first mold, injecting material into the first mold to form a first side surface, a second side surface, and an intermediary surface located between the first side surface and the second side surface, providing a primary lock structure, providing a medicament packaging structure, folding the first side surface relative to and towards the intermediary surface, folding the second side surface relative to and towards the intermediary surface until the second side surface and first side surface are substantially opposed to each other, rotatably attaching the medicament packaging structure between the first side surface and the second side surface, moving the primary lock structure towards the first side surface and second side surface, and locking the primary lock structure to the first side surface and second side surface.

According to another aspect of the disclosed subject matter, a method for making a medicament dispenser can include providing a first mold, injecting material into the first mold to form a first side surface, a second side surface, an intermediary surface located between the first side surface and the second side surface, and a primary lock structure extending from the intermediary surface, folding the first side surface relative to and towards the intermediary surface, folding the second side surface relative to and towards the intermediary surface until the second side surface and first side surface are substantially opposed to each other, moving the primary lock structure towards the first side surface and second side surface, and locking the primary lock structure to the first side surface and second side surface.

According to another aspect of the disclosed subject matter, a method for using a medicament dispenser can include providing a medicament dispenser including a first side surface, a second side surface, and a medicament packaging structure located between the first side surface and second side surface, the medicament packaging structure being moveable with respect to at least one of the first side surface and second side surface, the first side surface being substantially opposed to the second side surface and including a first lock-receiving portion, and the second side surface being substantially opposed to the first side surface and including a second lock-receiving portion, the medicament dispenser including a primary lock structure configured to releasably connect with the first lock-receiving portion and second lock-receiving portion to thereby restrain movement of the medicament packaging structure in at least one direction with respect to at least one of the first side surface and second side surface. The method can include moving the first lock-receiving portion and the second lock-receiving portion relative to the primary lock structure to unlock the first lock-receiving portion and the second lock-receiving portion from the primary lock structure, moving the primary lock structure away from the medicament packaging structure, and moving the medicament packaging structure relative to at least one of the first side surface and second side surface to place the medicament packaging structure in an exposed state.

According to another aspect of the disclosed subject matter, a method for using a medicament dispenser can include providing a medicament dispenser including a first side surface, a second side surface, a pivot structure extending between the first side surface and the second side surface, a medicament packaging structure located between the first side surface and second side surface and connected to the pivot structure such that medicament packaging structure is rotatable from an enclosed state within the first and second side surfaces to an exposed state substantially exposed from at least one of the first and second side surfaces, and a primary lock structure extending between the first side surface and second side surface and configured to prevent rotation of the medicament packaging structure when the primary lock structure is in a locked state and to allow rotation of the medicament packaging structure when the primary lock structure is in an unlocked state. The method can include moving the primary lock structure from the locked state to the unlocked state, and rotating the medicament packaging structure relative to at least one of the first side surface and second side surface to place the medicament packaging structure in the substantially exposed state.

According to another aspect of the disclosed subject matter, a method for using a medicament dispenser can include providing a medicament dispenser including a first side surface, a second side surface, and a medicament packaging structure located between the first side surface and second side surface, the medicament packaging structure being moveable with respect to at least one of the first side surface and second side surface, the first side surface being substantially opposed to the second side surface and including a flexible portion configured to be more flexible relative to a remaining portion of the first side surface, the medicament dispenser including a locking device having a first lock-receiving portion located at the flexible portion of the first side surface and a primary lock structure configured to releasably connect with the first lock-receiving portion to thereby restrain movement of the medicament packaging structure in at least one direction with respect to at least one of the first side surface and second side surface. The method can include moving the flexible portion of the first side surface relative to the remaining portion of the first side surface and thereby releasing the first lock-receiving portion from the primary lock structure, moving the primary lock structure away from the first lock-receiving portion, and moving the medicament packaging structure relative to at least one of the first side surface and second side surface to place the medicament packaging structure in an exposed state.

BRIEF DESCRIPTION OF THE DRAWINGS

The disclosed subject matter of the present application will now be described in more detail with reference to exemplary embodiments of the apparatus, given by way of example, and with reference to the accompanying drawings, in which.

Figure 1:
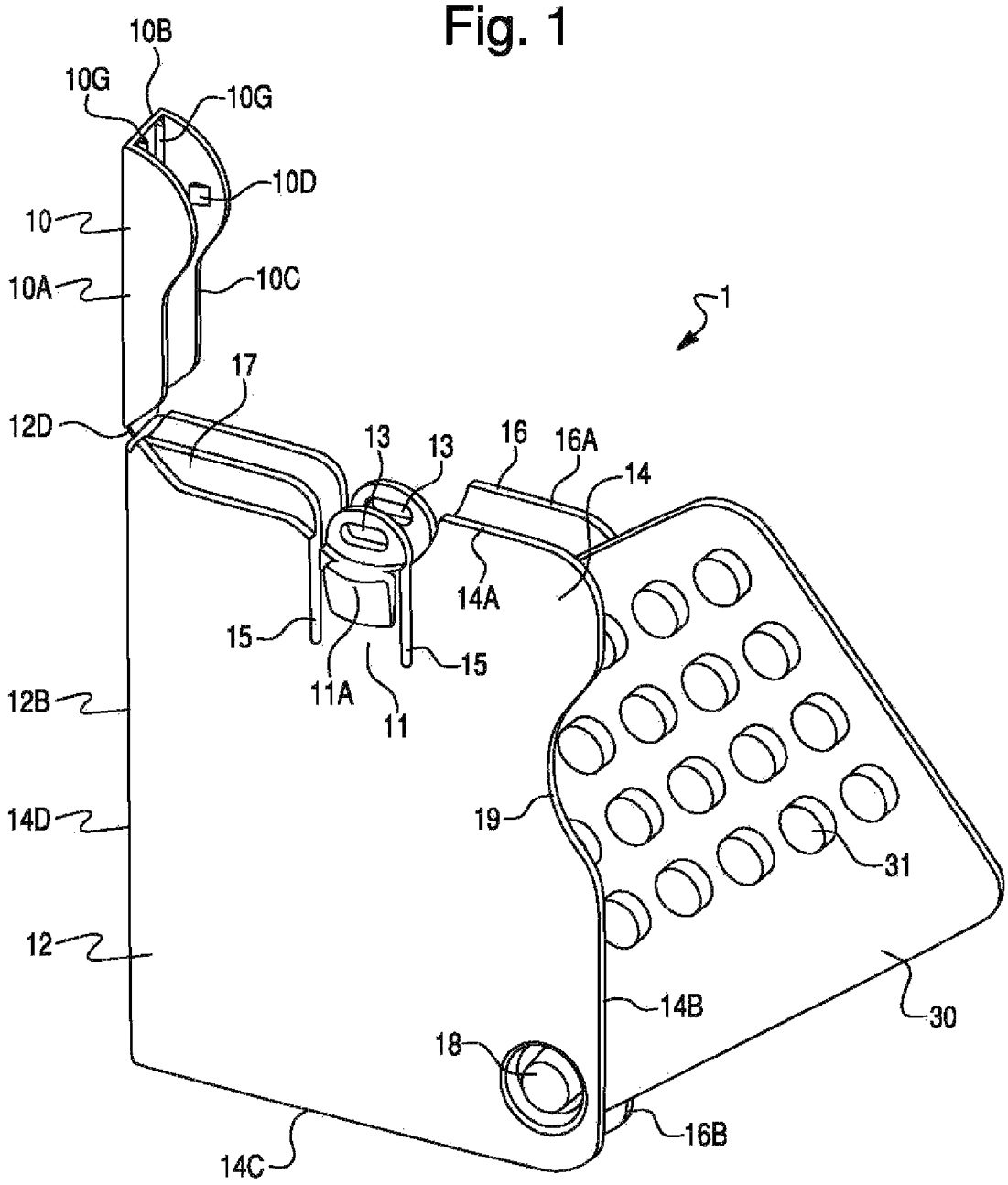
FIG. 1 is a perspective view of a medicament dispenser made in accordance with principles of the disclosed subject matter.

Still other aspects, features and characteristics of the disclosed subject matter will become apparent to those skilled in the art from a reading of the following detailed description of embodiments constructed in accordance therewith, and taken in conjunction with the accompanying drawings.

DETAILED DESCRIPTION OF EXEMPLARY EMBODIMENTS

Referring to the drawing figures, like reference numerals designate identical or corresponding elements throughout the several figures.

FIG. 1 shows a perspective view of a medicament dispenser 1 in a semi-opened state. The dispenser 1 can include a housing 12 formed of a single continuous and homogenous piece of plastic, fiber board, metal, paper board, other rigid or semi-rigid material(s), or other material(s) commonly known to those skilled in the art. Of course, as will be described in more detail below, the housing 12 need not be made from a single continuous piece of material, but can be made from multiple parts that are connected by separate and distinct structures or films, adhesives, or the like. In the embodiment shown in FIG. 1, the housing 12 includes a first side surface 14 that is opposed to a second side surface 16.

Figure 2:
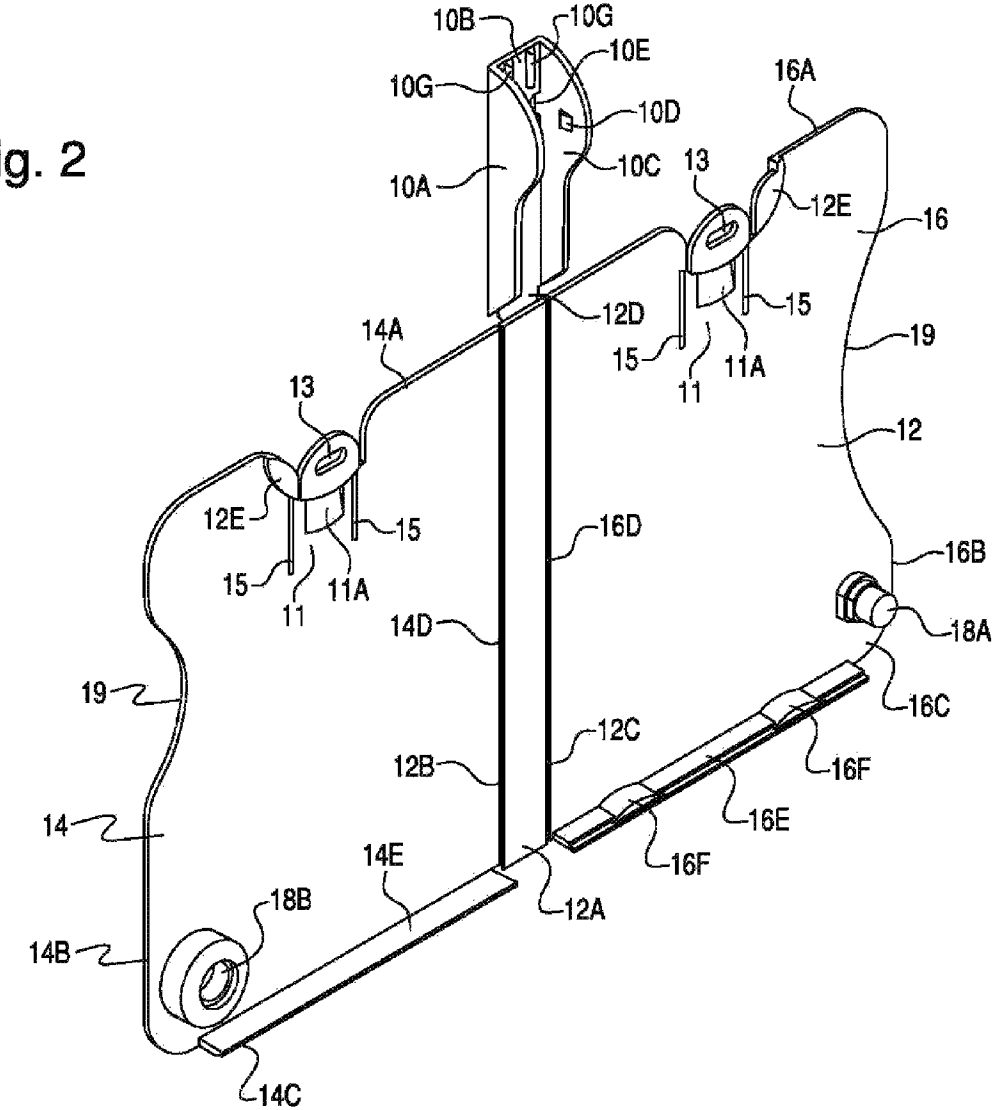
FIG. 2 is a perspective view of the medicament dispenser of FIG. 1 in a state just after release from a mold during manufacture.

As shown in FIG. 2, the first side surface 14 and second side surface 16 can be connected via a binding portion 12A. The binding portion 12A can include a first side crease 12B that extends along a juncture between the binding portion 12A and the first side surface 14. Likewise, the binding portion 12A can include a second side crease 12C that extends along a juncture between the binding portion 12A and the second side surface 16. The creases 12B and 12C allow the first side surface 14 and second side surface 16 of the housing 12 to be folded towards each other and into an opposing configuration during manufacture of the dispenser 1.

The first side surface 14 can include a top edge 14A, an opening/side edge 14B, a bottom edge 14C, and a back side edge 14D. The second side surface 16 can likewise include a top edge 16A, an opening/side edge 16B, a bottom edge 16C, and a back side edge 16D. The depicted embodiment discloses an access notch 19 provided in the opening edge 14B. The access notch 19 can be configured and shaped such that a user can easily grasp the medicament packaging structure 30 located between the first side surface 14 and second side surface 16. Access to the medicament packaging structure 30 allows the user to rotate the medicament packaging structure 30 from a stored position to an opened or access position. In the stored position, the medicament packaging structure 30 is located between and totally or at least substantially covered by the first side surface 14 and/or second side surface 16. In the opened position, the medicament packaging structure 30 is substantially or at least partially exposed from at least one of the first side surface 14 and second side surface 16 such that a user has access to the medicament packaging structure 30. For example, when the medicament packaging structure 30 is configured as a blister pack, the pockets 31 of the blister pack can be exposed to a degree necessary for a user to release a medicament located inside the pockets 31 when the medicament packaging structure 30 is in the opened position.

A connecting/pivot structure 18 can be located on one or both of the first side surface 14 and second side surface 16 such that, when the first side surface 14 and second side surface 16 of the housing 12 are folded towards each other and in an opposing configuration, they can be locked or retained together in that opposing configuration. In addition, the connecting/pivot structure 18 can be configured such that the medicament packaging structure 30 can be rotatably mounted to the connecting/pivot structure 18. Specifically, the medicament packaging structure 30 can include an aperture through which the connecting/pivot structure extends. In the embodiment shown in the appended drawings, the connecting/pivot structure 18 is formed by a female recess located at a bottom interior corner of the first side surface 14 and a mating male extension extending from the bottom interior corner of the second side surface 16. The bottom corner can be distal with respect to the binding portion 12A.

The first side surface 14 can include a flexible structure 11 formed by slits 15 that extend from a top edge 14A of the first side surface 14 downward. In the embodiment shown, the slits extend parallel to each other and towards a central portion of the first side surface 14. The second side surface 16 can also include a flexible structure 11 formed by slits 15 that extend downward from a top edge 16A of the second side surface 16. The slits 15 also extend parallel to each other and towards a central portion of the second side surface 16 in the shown embodiment. The flexible structures 11 can be configured such that they are directly opposed to each other when the first side surface 14 is directly opposed to the second side surface 16. In addition, the flexible structures 11 can include a projection or projections 11A that serve as a thumb or finger rest. The projection(s) can be manually depressed during an unlocking operation for the dispenser 1 to move the flexible structure(s) with respect to a remainder portions of the first side surface 14 and second side surface 16, respectively, and with respect to the primary lock structure 10.

A lock aperture 13 can be located in each of the flexible structures 11 and located proximal the top edge 14A, 16A of each of the first side surface 14 and second side surface 16, respectively. The lock apertures 13 can be configured to mate with a respective lock tooth 10D of a primary lock structure 10. The primary lock structure 10 as shown in FIG. 1 is in an unlocked state with the medicament packaging structure rotated out into a dispensing state. In this state, a user can press a pocket 31 to release a medicament via a rupturable seal. Typically the pockets 31 are made from a plastic material while the rupturable material can be a foil, a paper, a plastic film, a combination, or other material(s) common to those skilled in the art.

Figure 3:
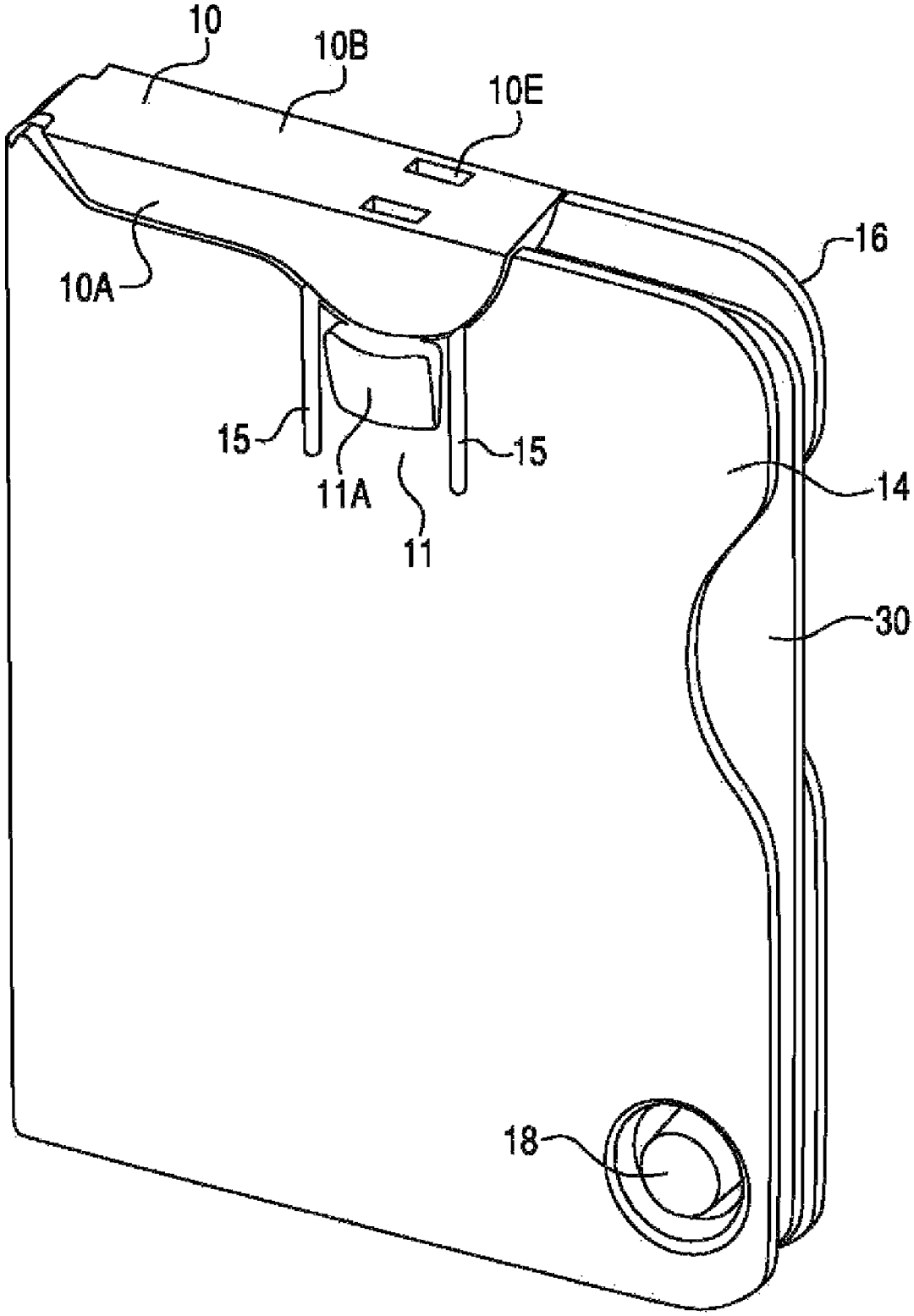
FIG. 3 is a perspective view of the medicament dispenser of FIG. 1 in a closed and locked state.

A primary lock structure 10 can be attached to the binding 12A of the housing 12 via a living hinge 12D such that the primary lock structure is rotatable between a locked position and an unlocked position (the unlocked position shown in FIG. 1). In the locked position, sides 10A and 10C of the primary lock structure 10 will rest and be supported by landings 17 located on the top edges 14A and 16A of the first side surface 14 and second side surface 16, respectively. Additionally, a lock tooth 10D can be formed on an interior portion of each of the sides 10A and 10C such that they oppose each other and are configured to mate with apertures 13 to lock the primary lock structure 10 in place. When in the locked position, the primary lock structure 10 resides along the top edges 14A and 16A of the first and second side surfaces 14 and 16, as shown in FIG. 3.

FIG. 2 is a perspective view of the medicament dispenser 1 of FIG. 1 in a state just after release from a mold during manufacture of the dispenser 1. As shown, the dispenser 1 is in a flat opened state. The bottom edge 14C can include a bottom ledge 14E that is configured to extend towards the opposing second side surface 16 when the dispenser 1 is folded into its finally manufactured form. The bottom edge 16C can include a bottom ledge 16E that likewise extends towards the opposing first side surface 14 when the dispenser 1 is in its finally manufactured form and mates with the bottom ledge 14E to provide a shelf upon which the medicament packaging structure 30 can rest when in the stored position. Spacers 16F can be provided on the bottom ledge 16E such that a medicament packaging structure 30 can be positioned correctly and to prevent the bottom ledge 14E from riding up and over bottom ledge 16E either during manufacture or when subjected to exterior forces during use of the dispenser 1.

The connecting/pivot structure 18 is shown as including a female recess 18B in the first side surface 14 and a mating male protrusion 18A located in a corresponding position of the second side surface 16. An access notch 19 can be provided in the second side surface 16 to correspond with the access notch 19 in the first side surface 14 and permit a user to easily grasp the medicament packaging structure 30 located between the first side surface 14 and second side surface 16. The housing 12 can include centering guards 12E located adjacent both respective top edges 14A and 16A and on either side of each of the flexible portions 11. The guards 12E can ensure that the first side surface 14 and second side surface 16 maintain a spacing therebetween such that the flexible structures 11 have space to flex inward relative to each other. Thus, the guards 12E also ensure proper and consistent actuation and operation of the lock mechanism.

The primary lock structure 10 is shown as being connected to the binding portion 12A by a living hinge 12D. A first lock side surface 10A opposes a second lock side surface 10C and each include a lock tooth 10D located in opposed fashion to each other on respective side surfaces 10A and 10C. The lock teeth 10D are configured to mate with and lock with respective apertures 13 in the flexible structures 11 of the first side surface 14 and second side surface 16, respectively, when the primary lock structure 10 is rotated about the living hinge 12D and mated with the top edges 14A and 16A. Apertures 10E (See FIG. 3) in the top lock surface 10B are provided such that the housing 12 can be manufactured using any of several known manufacturing techniques, such as injection molding, blow molding, press molding, and/or stamping. Specifically, the apertures 10E allow each lock tooth 10D to be formed in a single injection and/or from the same homogenous and continuous piece of material forming the housing 12. In addition, walls 10G can be located in the interior of top lock surface 10B to help keep the first side surface 14 and second side surface 16 equally spaced from each other when the primary lock structure 10 is in the locked position.

FIG. 3 shows the dispenser 1 in a locked state in which the primary lock structure 10 is located on the top edges 14A and 16A of the first side surface 14 and second side surface 16, respectively. In this state, the lock teeth 10D (shown in FIG. 2) are located in the apertures 13 in the flexible structures 11 of each respective side surface 14 and 16. The medicament packaging structure 30 is also locked within the first side surface 14 and second side surface 16 by the primary lock structure 10. In particular, the primary lock structure 10 prevents the medicament packaging structure 30 from rotating about the connecting/pivot structure 18. Thus, the medicament packaging structure 30 is safely retained and inadvertent contact with, opening or exposure of the medicament packaging structure 30 can be prevented.

In operation, the medicament packaging structure 30 can be moved from the locked state to an unlocked or exposed state by at least three separate movements or actions. First, the user simultaneously depresses each of the flexible structures 11 on each of the side surfaces 14 and 16 to move each of the flexible structures 11 with respect to a remainder portion of each of the respective side surfaces 14 and 16. The movement of the flexible structures 11 also results in movement of the structures 11 with respect to respective first lock side surface 10A and second lock side surface 10C. Thus, when the relative movement between the flexible structures 11 and respective first lock side surface 10A and second lock side surface 10C extends beyond a predetermined distance, the flexible structures 11 are considered to be in a depressed state at which the lock teeth 10D can be released or disengaged from respective apertures 13 in the flexible structures 11.

While holding the flexible structures 11 at the predetermined distance in the depressed state (or immediately upon arrival at the predetermined distance) the user can then rotate or otherwise move the primary lock structure 10 relative to the first and second side surfaces 14 and 16. Thus, the action of moving the primary lock structure 10 occurs after the first action of initially depressing the flexible structures 11, but occurs simultaneous with the action of placing the flexible structures 11 in the depressed state (i.e., holding or simply arriving at the depressed state).

Accordingly, it is difficult for a child or other user (e.g., elderly user, impaired user, other similar user) to access packaging structure 30 because the two actions of placing the flexible structures 11 in the depressed state and rotating the primary lock structure 10 are difficult for a child or other user to simultaneously execute.

After the primary lock structure 10 is moved a certain distance away from the first and second side surfaces 14 and 16, the user can then conduct a third action of rotating the medicament packaging structure 30 about connecting/pivot structure 18 to an exposed or dispensing state. The medicament(s) stored within the medicament packaging structure 30 can then be accessed.

The dispenser 1 and medicament packaging structure 30 can be returned to its locked state by rotating the medicament packaging structure 30 back into position within the first side surface 14 and second side surface 16, and then placing or rotating the primary lock structure back onto the top edges 14A and 16A of the first side surface 14 and second side surface 16. The primary lock structure 10 can be locked in place by lining up the lock teeth 10D with the apertures 13 in the flexible structures 11. By moving the primary lock structure 10 onto the flexible structures 11, the flexible structures 11 will flex or move inward toward each other to allow the primary lock structure 10 to be moved onto the top edges 14A and 16A and into its locking position. When the primary lock structure 10 arrives at its locked position, the lock teeth 10D of the primary lock structure 10 snap into the apertures 13 of respective flexible structures 11, allowing the flexible structures 11 to move back into their original non-flexed position to lock the primary lock structure 10 with respect to the first and second side surfaces 14 and 16.

Figure 4:
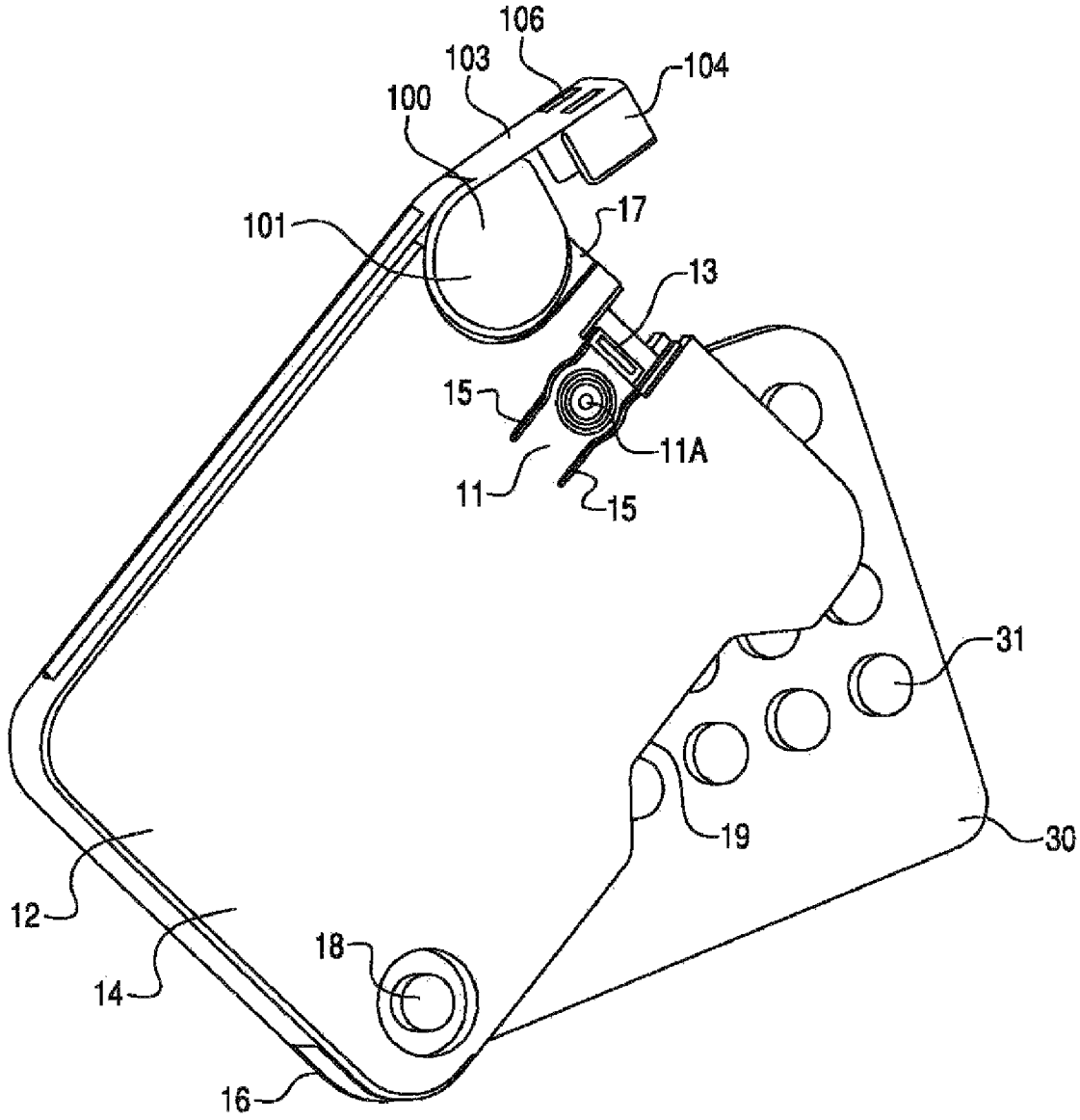
FIG. 4 is a perspective view of another embodiment of a medicament dispenser made in accordance with principles of the disclosed subject matter.
Figure 5:
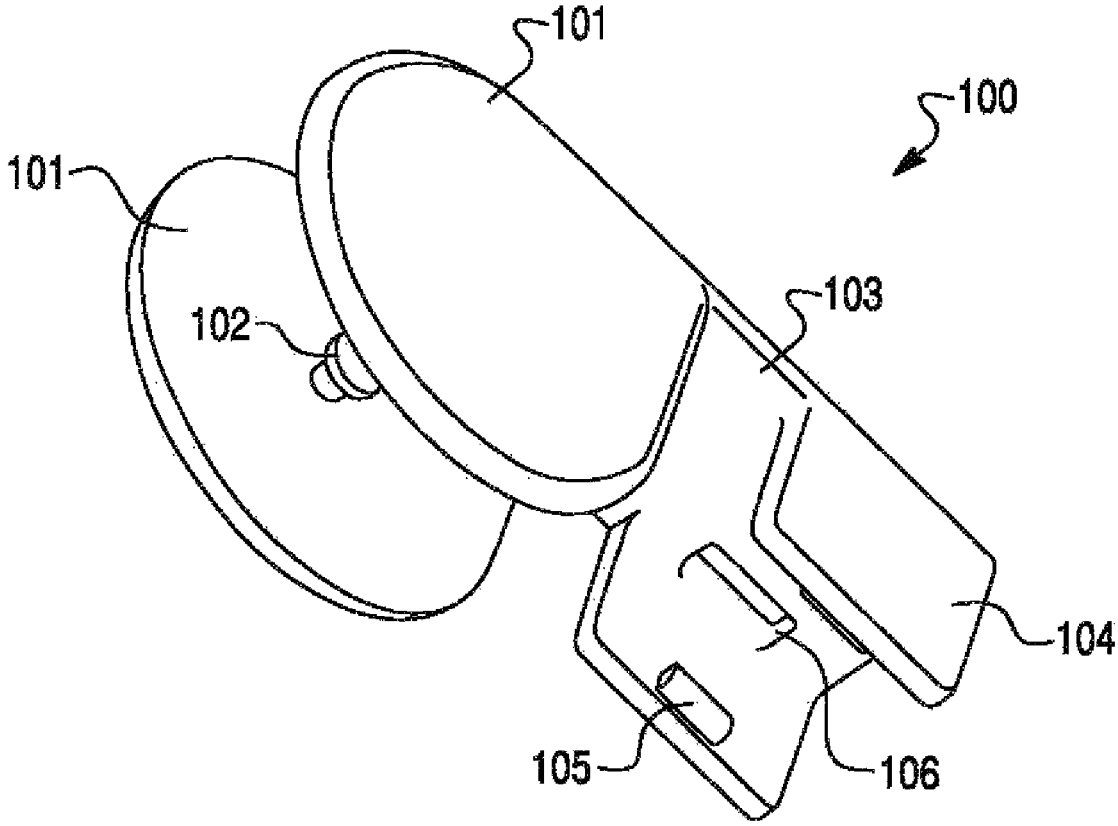
FIG. 5 is a perspective view of a portion of the lock structure for the medicament dispenser of FIG. 4.

FIGS. 4 and 5 are a perspective view of another embodiment of a dispenser 1 made in accordance with principles of the presently disclosed subject matter along with a detailed perspective view of the associated primary lock structure 100. In this embodiment, the primary lock structure 100 is configured as a separate structure that includes a rotary surface structure 101 extending from and substantially normal to each side of a top lock surface 103. Likewise, a locking wall structure 104 also extends from and is substantially normal to each side of the top lock surface 103. The rotary surface structure 101 and the locking wall structure 104 can be spaced from each other along a longitudinal direction of the top surface 103. A lock tooth 105 can be located on an interior side of each of the locking wall structures 104, and can be substantially opposed to each other along an imaginary line that is normal to the longitudinal direction of the top surface 103. Apertures 106 can be provided in the top surface 103 so that the lock teeth 105 can be easily molded (if appropriate or desired) into the primary lock structure 100. A lock axle 102 can extend from an interior side of each of the rotary surface structures 101, and can be substantially opposed to each other along an imaginary line that is normal to the longitudinal direction of the top surface 103 and substantially normal to a plane containing a respective rotary surface structure 101. The lock axles 102 are configured to be inserted into respective apertures located in each of the first side surface 14 and second side surface 16 of the housing 12.

When the primary lock structure 100 is attached to the first side surface 14 and second side surface 16, it can be rotated about the lock axles 102 from an unlocked position as shown in FIG. 5 to a locked position in which the top surface 103 primary lock structure 100 lies upon and/or is substantially flush or parallel with the top surface edges of each of the first side surface 14 and second side surface 16. In the locked position, the lock teeth 105 can extend into apertures 13 located in flexible structures 11 in each of the first side surface 14 and second side surface 16.

The operation of the primary lock structure 100 can be similar to that of the primary lock structure 10. However, instead of being rotated about a living hinge, the primary lock structure 100 will rotate about a fixed lock axle 102. In addition, the flexible structure 11 of this embodiment can be formed via slits 15 that are shaped to form a substantially circular finger press portion 11A therebetween. Concentric grooves or ridges can be provided on the finger press portions 11A to provide a user a visual cue to depress at that portion, and can provide a higher friction surface upon which a user can depress to move the flexible structures 11 relative to respective remaining portions of the first side surface 14 and second side surface 16. The access notches 19 are also more angular in shape. In addition, the landings 17 located each of the first side surface 14 and second side surface 16 are shaped to provide a landing and rotational surface for the rotary surface structures 101 on each side of the top lock surface 103.

The dispenser 1 can be constructed from various materials and combinations of materials. For example, the housing 12 can be a plastic that is easily moldable, but could also be formed of a pressed paper board laminate material, paper composite, metal, ceramic, and/or other conventionally known materials. In addition, as described above, the medicament packaging structure 30 can be made from a paper composite material, metal, plastic or combination of materials. In particular, the medicament packaging structure 30 can include a rupturable foil backing with a plastic bubble portion located over the medicament(s). A paper or paper board can be interposed between the foil and plastic, or the foil can be interposed between the paper/paperboard and plastic. Indicia can be printed on the medicament packaging structure 30 to provide instructions for use, warnings, and the like. Alternatively, a separate instructional page or booklet could be pivoted in and/or connected within the housing structure 12. Thus, information such as drug interaction information, accidental ingestion information, dosage instructions, and warnings can be carried with the blister packs (or other types of holders) which contain the medicament to which the information relates.

Figure 6A:
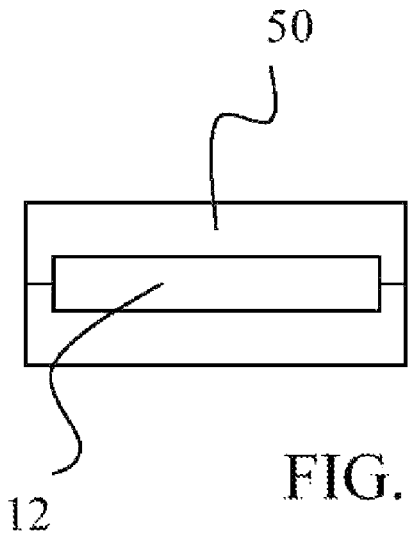
FIGS. 6A-6E are schematic views representing a method for manufacturing a medicament dispenser in accordance with principles of the disclosed subject matter.
Figure 6B:
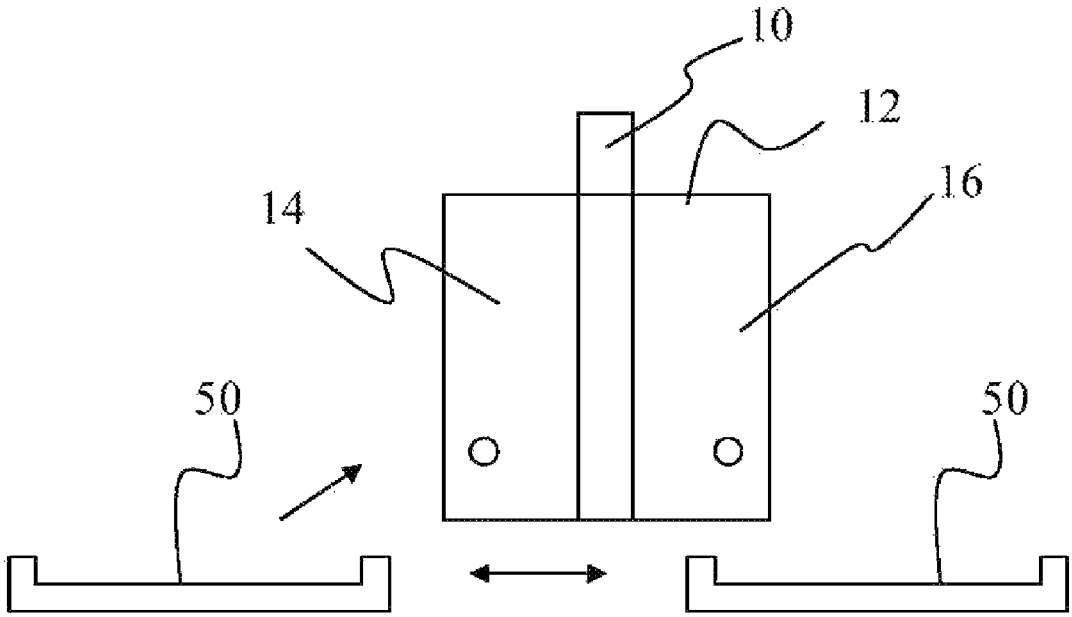
Figure 6C:
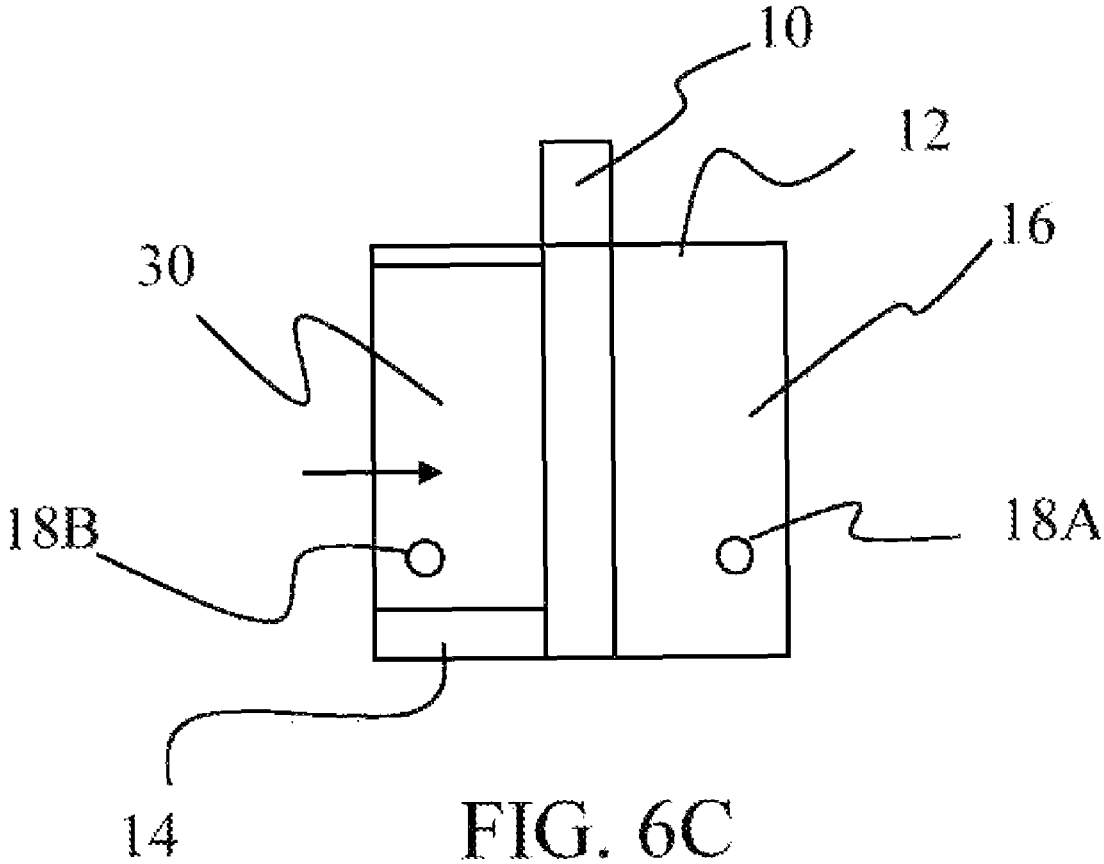
Figure 6D:
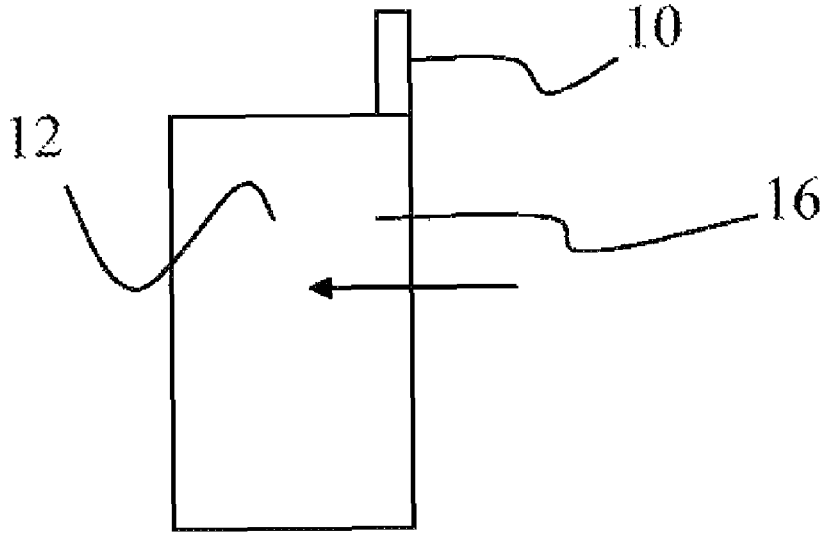
Figure 6E:
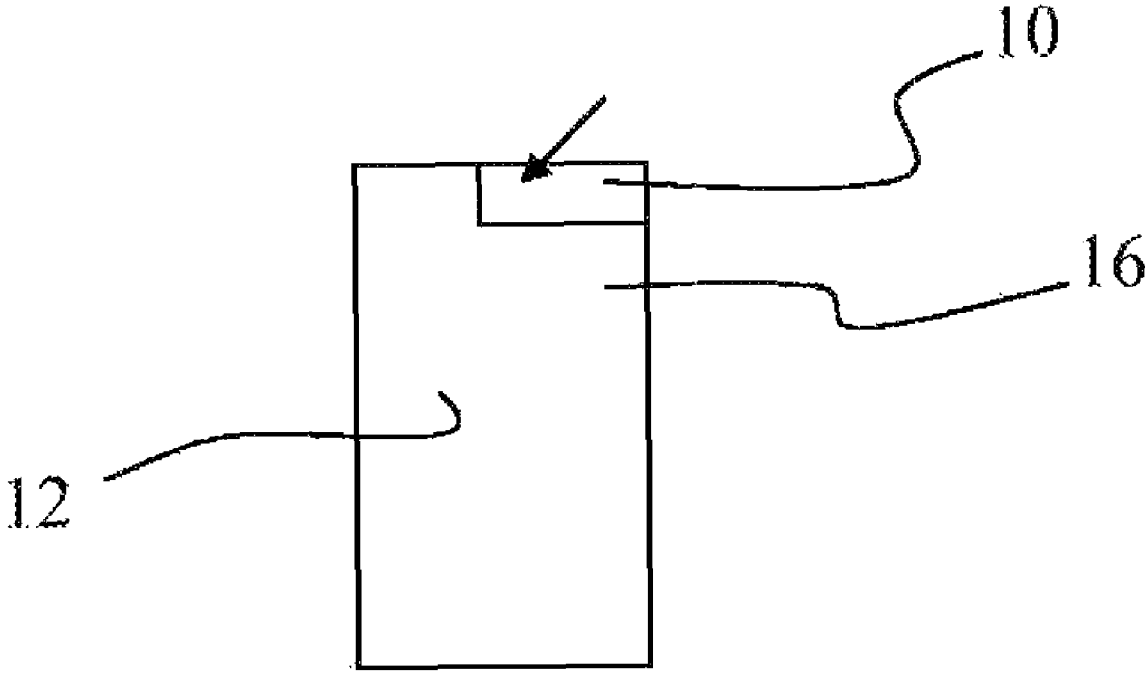

FIGS. 6A-E show schematic views representing a method for manufacturing a medicament dispenser 1 in accordance with principles of the disclosed subject matter. An example of a method for making a medicament dispenser 1 can include providing a first mold 50 and then injecting material into the first mold to form a housing 12 that includes a first side surface 14, a second side surface 16, and an intermediary binding surface 12A located between the first side surface 14 and the second side surface 16, as shown in FIG. 6A. A primary lock structure 10 can be formed with the same injection (or in another injection process) and can be connected to the binding surface 12A via a living hinge 12D. The mold 50 can then be opened as shown in FIG. 6B and the housing 12 including the primary lock structure 10 can be removed from the mold 50. A medicament packaging structure 30 can then be placed on the second side surface 16 such that the pivot structure 18A extends through an aperture in the medicament packaging structure 30, as shown in FIG. 6C. The first side surface 14 and/or second side surface 16 can then be folded along creases 12B and 12C respectively towards each other or towards an intermediary surface, such as binding portion 12A. The second side surface 16 can be folded relative to and towards the intermediary surface until the second side surface 16 and first side surface 14 are substantially opposed to each other and until the male portion 18A of the connecting/pivot structure 18 mates with the female portion 18B of the connecting/pivot structure 18 to lock the first side surface 14 in an opposed state with respect to the second side surface 16, as shown in FIG. 6D. Once the medicament packaging structure 30 is in place and the first side surface 14 is locked in its opposing relationship to the second side surface 16, the primary lock structure 10 can then be folded about the living hinge 12D towards the top edges 14A and 16A of the first side surface 14 and second side surface 16, respectively. The flexible structures 11 should flex inward until the lock teeth 10D of the primary lock structure 10 arrive at the apertures 13 in the flexible structures. At that time, the lock teeth 10D will snap into the apertures 13 and the flexible structures 11 will return to their non-flexed position, locking the primary lock structure 10 to the first side surface 14 and second side surface 16, as shown in FIG. 6E. In this state, the medicament storage structure 30 is in a locked state within the first side surface 14 and second side surface 16, and the primary lock structure 10 prevents the medicament storage structure 30 from rotating about the connecting/pivot structure 18.

While certain embodiments of the disclosed subject matter are described above, it should be understood that the disclosed subject matter can be embodied and configured in many different ways without departing from the spirit and scope of the disclosed subject matter. For example, the slits 15 can be configured as slots that extend the entire distance through the thickness of (in a direction normal to) the respective first side surface 14 or second side surface 16. However, the slits 15 can also only extend partially through the first side surface 14 and/or second side surface 16. In addition, a second material or film can be provided over or under the slits 15 to provide a desired elasticity for the flexible structures 11 relative to the remaining portions of the first side surface 14 and second side surface 16. In addition, the apertures 13 in the flexible structures 11 and mating lock teeth (10D, 104) can be reversed. In other words, the flexible structures 11 can be provided with lock teeth and the primary lock structure (10, 100) can be provided with apertures. The lock teeth lock teeth (10D, 104) and apertures can also be variously shaped, including more positive ratcheting lock structures or differently shaped cross sectional shapes or surfaces. For example, the primary lock structure (10, 100) could include lock teeth (10D, 105) that extend parallel with the locking wall structure (10A, 104) for insertion into an aperture 13 that has an insertion axis parallel with the first side surface 14 or second side surface 16. Thus, a user depresses the locking wall structure (10A, 104) instead of the flexible structures 11 to release the primary lock structure (10, 100).

The first side surface 14 can also be configured to be rotatable with respect to the second side surface 16 such that when the primary lock structure (10, 100) is released, the first side surface 14 can be rotated with respect to the second side surface 16 to expose a portion of the medicament packaging structure 30 and provide a user access to the medicament(s) stored therein. In this configuration, the primary lock structure 10 can be configured to be wholly removed from the first side surface 14 and second side surface 16 to unlock the dispenser.

The creases 12B, 12C, and living hinge 12D can be formed of material that is relatively thinner than adjacent structures that are connected via either the creases or the living hinge (i.e., crease 12B can be thinner than the binding portion 12A and the adjacent first side surface 14, crease 12C can be thinner than the binding portion 12A and the adjacent second side surface 16, and living hinge 12D can be thinner than the binding portion 12A and the adjacent primary lock structure 10). The relative thinness of each of the creases and living hinge can be determined by the amount of flex that is desired for either the crease or living hinge, and can be configured to have a thinness relative to adjacent connected structures such that a user can easily rotate the adjacent connected structures with respect to each other, while also being thick enough to prevent destruction or tearing of the crease or living hinge during use and/or such that the crease or living hinge can guide the adjacent structures relative to each other during relative movement of the adjacent connected structures.

While the figures depict the creases 12B and 12C and living hinge 12D as thinner portions of material, these creases and the living hinge can also be formed as perforations in a uniformly thick material, an otherwise weakened portion of the material, an equally thick/thin portion as at least one of the adjacent structures and that can be creased or folded, a separate taped or hinged portion, or combinations thereof. In particular, a tape or other material can be used to attach the primary lock structure 10 to the binding portion 12A. Likewise, tape could be used to bind the first side surface 14 and second side surface 16 in place of the binding portion 12A. Alternatively, each of the side surfaces 14, 16, and the lock structure 10 (or combinations thereof) could be formed with a snap fit hinge that connects with a mating snap fit hinge of a joining surface section which is to rotate with respect to each other (for example, between the binding portion 12A and first side surface 14, or between the primary lock structure 10 and binding portion 12A. Of course, separate hinge mechanisms could also be installed at some or all of the locations at which rotation between adjacent parts is expected. As contemplated in the above description, the living hinge 12D could be eliminated altogether and the primary lock structure (10, 100) could thus be manufactured as a separate piece that can be completely removed from the side surfaces 14, 16 and binding portion 12A when unlocked from the side surfaces 14, 16.

It is also conceivable that the dispenser 1 include structures to provide substantially more protection for the medicament packaging structure 30 located within the housing 12. For example, the housing can include portions that seal a perimeter between the first side surface 14 and second side surface 16 to protect the entire medicament packaging structure 30 from exposure to any water, air, contaminants, outside forces, or other environmental factors. Of course, the protective seal portions would have to be removable when the primary lock structure (10, 100) is unlocked so that the medicament packaging structure 30 can be placed into an exposed or unlocked state. It is conceivable that a peal away border could be provided about the periphery of the first side surface 14 and second side surface 16. Alternatively, the medicament packaging structure 30 itself could be provided with a closing structure such as a rubber gasket or foam gasket located around a perimeter of the medicament packaging structure 30 to mate with the first side surface 14 and second side surface 16 and to substantially or totally seal an interior portion of the medicament packaging structure 30 within the housing 12 when the dispenser 1 is in a locked state.

By contrast, the medicament packaging structure 30 located within the housing 12 could also be made such that the medicament located therein is much easier to access than when a typical blister packaging type arrangement is used for the medicament packaging structure 30. Because the housing 12 can provide a barrier to access to the medicament, a very thin and easily broken foil can be used to cover an exitway from a blister in the medicament packaging structure 30 so that displacement of a medicament from the blister is relatively easy. The housing 12 and primary lock structure 10, 100 could be the primary means to protect unauthorized or undesired access to the medicaments located in the medicament packaging structure 30. In addition, non-blister type holders could be used as the medicament packaging structure 30. For example, a strip of material could be used with the medicament adhered directly to the strip, or a medicament could be located in separate paper window box structures, or other similar structures generally known in the art could be used.

The connecting/pivot structure 18 can be formed differently and remain within the scope and spirit of the disclosed subject matter. For example, the structure 18 could be separated into a separate pivot portion and separate connection structure, where the pivot structure extends through the medicament packaging structure 30 while the connection structure could be built into the binding portion 12A or other portion of the housing 12. The pivot portion could also be located away from the edge of the housing 12 and edge of the medicament packaging structure 30. For example, the pivot could be located centrally such that the medicament packaging structure 30 could be rotated within and exposed form a window in at least one of the first side surface 14 and second side surface 16. The primary lock structure 10, 100 could prevent the medicament packaging structure 30 from rotating, while keeping it optionally or selectively locked at many different rotational positions.

While the subject matter has been described in detail with reference to exemplary embodiments thereof, it will be apparent to one skilled in the art that various changes can be made, and equivalents employed, without departing from the scope of the invention. All related art references discussed in the above Description of the Related Art section are hereby incorporated by reference in their entirety.

What is claimed is:

1. A medicament dispenser including:

a housing;

a blister pack internally attached to said housing by a corner pivot having a first axis;

a primary lock structure rotatable around a second axis diagonally opposed to said pivot; and a first lock-receiving structure connected to the housing and to said primary lock structure, said first lock-receiving structure locking said primary lock structure to said housing.

2. The medicament dispenser of claim 1, wherein the housing includes a first side surface and a second side surface spaced from and substantially opposed to the first side surface; and the first side surface includes the first lock-receiving structure that is relatively more flexible with respect to a remainder portion of the first side surface and includes a mating structure that interlocks with a respective mating structure on the primary lock structure when in a locked state, and the second side surface includes a second lock-receiving structure that is relatively more flexible with respect to a remainder portion of the second side surface and includes a second mating structure that interlocks with a respective second mating structure on the primary lock structure when in the locked state.

3. The medicament dispenser of claim 2, wherein the first lock-receiving structure is defined by a pair of slits that extend from an edge of the first side surface towards an inner portion of the first side surface such that the slits contribute to relative flexibility between the first lock-receiving structure and the remainder portion of the first side surface.

4. The medicament dispenser of claim 1, wherein the housing includes a first side surface and a second side surface spaced from and substantially opposed to the first side surface; and the medicament dispenser further comprising an intermediary side surface located between the first side surface and the second side surface.

5. The medicament dispenser of claim 4, further comprising a living hinge located between the intermediary side surface and the primary lock structure.

6. The medicament dispenser of claim 5, wherein the primary lock structure, the living hinge, the intermediary side surface, the first side surface, and the second side surface are integrally formed of a single unitary construction and are all formed of a same continuous material.

7. The medicament dispenser of claim 2, further comprising an intermediary side surface located between the first side surface and the second side surface.

8. The medicament dispenser of claim 7, wherein the intermediary side surface, the first side surface, the second side surface, the first lock-receiving structure, and the second lock-receiving structure are integrally formed of a single unitary construction and are all formed of a same continuous material.

9. The medicament dispenser of claim 2, wherein the mating structure of the first lock-receiving structure includes at least one of an aperture and a tab that extends in a direction substantially normal to the first side surface, and the respective mating structure of the primary lock structure includes at least one of an aperture and a tab that extends in a direction substantially normal to the first side surface.

10. The medicament dispenser of claim 1, wherein the blister pack includes a backing substrate, a blister substrate, and a medicament, and the blister substrate includes a plurality of separate three dimensional blister shapes, and the backing substrate is configured to be rupturable at each location of the separate three dimensional blister shapes.

11. The medicament dispenser of claim 10, wherein the backing substrate includes a metal foil, and the blister substrate includes a plastic.

12. The medicament dispenser of claim 1, wherein the housing includes a first side surface and a second side surface spaced from and substantially opposed to the first side surface; and wherein the primary lock structure includes at least one of an aperture and an axle extending substantially normal to a wall of the primary lock structure, and at least one of the first side surface and second side surface includes at least one of an aperture and an axle extending substantially normal to a respective one of the first side surface and second side surface.

13. The medicament dispenser of claim 1, wherein the housing includes a first side surface and a second side surface spaced from and substantially opposed to the first side surface; and wherein the first side surface includes a plurality of slits that define the first lock-receiving structure.

14. The medicament dispenser of claim 1, wherein the housing includes a first side surface and a second side surface spaced from and substantially opposed to the first side surface; and wherein the first lock-receiving structure is defined by at least two slits that extend from an edge of the first side surface towards an inner portion of the first side surface.

15. A method for making the medicament dispenser of claim 1, comprising:

providing a first mold;

injecting material into the first mold to form the housing, including: a first side surface, a second side surface, and an intermediary surface located between the first side surface and the second side surface;

providing the primary lock structure;

providing the blister pack;

folding the first side surface relative to and towards the intermediary surface;

folding the second side surface relative to and towards the intermediary surface until the second side surface and first side surface are substantially opposed to each other;

rotatably attaching the blister pack between the first side surface and the second side surface;

moving the primary lock structure towards the first side surface and second side surface; and locking the primary lock structure to the first side surface and second side surface.

16. The method for making a medicament dispenser of claim 15, wherein injecting material into the first mold includes simultaneously forming the primary lock structure with the material, the primary lock structure extending from the intermediary surface.

17. The method for making a medicament dispenser of claim 15, further comprising:

providing the corner pivot located on at least one of the first side surface and the second side surface, wherein rotatably attaching the blister pack includes moving the corner pivot through an aperture in the blister pack.

18. The method for making a medicament dispenser of claim 15, wherein locking the primary lock structure to the first side surface and second side surface occurs after rotatably attaching the blister pack such that the primary lock structure prevents rotation of the blister pack.

19. The method for making a medicament dispenser of claim 15, further comprising:

rotatably attaching the primary lock structure to at least one of the first side surface and the second side surface via an axle located in at least one of the primary lock structure, the first side surface, and the second side surface, and via an aperture located in a respective other of the primary lock structure, the first side surface, and the second side surface.

20. The method for making a medicament dispenser of claim 15, wherein injecting includes forming a living hinge between the primary lock structure and the intermediary surface such that the primary lock structure is rotatably attached to the intermediary surface via the living hinge.

21. A method for using the medicament dispenser of claim 1, comprising:

providing the housing, including a first side surface and a second side surface, the blister pack internally attached to the housing by the corner pivot, the first lock-receiving structure connected to the housing and to the primary lock structure, and a second lock-receiving structure;

moving the first lock-receiving structure and the second lock-receiving structure relative to the primary lock structure to unlock the first lock-receiving structure and the second lock-receiving structure from the primary lock structure;

moving the primary lock structure away from the blister pack; and moving the blister pack relative to at least one of the first side surface and second side surface to place the blister pack in an exposed state.

22. The method for using a medicament dispenser of claim 21, further comprising:

providing the corner pivot that joins the first side surface and second side surface, wherein moving the blister pack includes rotating the blister pack about the corner pivot.

23. The method for using a medicament dispenser of claim 21, wherein moving the first lock-receiving structure includes moving the first lock-receiving structure relative to a portion of the first side surface and towards the second lock-receiving structure, and moving the second lock-receiving structure includes moving the second lock-receiving structure relative to a portion of the second side surface and towards the first lock-receiving structure.

24. The medicament dispenser of claim 1, wherein the second axis is located at a position that is diagonal to a position of said pivot.

25. The medicament dispenser of claim 1, wherein at least one of the second axis and the pivot is located at a position spaced from a corner of the housing.

26. The medicament dispenser of claim 1, wherein the housing is formed in a polygonal shape as viewed from a distance spaced from a side surface of the housing.

27. The medicament dispenser of claim 26, wherein the second axis is located at a position that is diagonal to a position of said pivot.

* * * * *